US006158185A

United States Patent [19]

Counihan

[11] Patent Number: 6,158,185

[45] Date of Patent: Dec. 12, 2000

[54] RESILIENT FLOORING

[76] Inventor: James Counihan, 50 Griffin Mill Rd., Piedmont, S.C. 29673

[21] Appl. No.: 09/305,898

[22] Filed: May 5, 1999

[51] Int. Cl.[7] ..... E04F 15/22

[52] U.S. Cl. ..... 52/403.1; 52/480; 52/506.05; 52/512

[58] Field of Search ..... 52/403.1, 480, 52/512, 591.4, 506.05, 549

[56] References Cited

U.S. PATENT DOCUMENTS

| | | | |
|---|---|---|---|
| 3,786,608 | 1/1974 | Boettcher | 52/480 |
| 4,599,842 | 7/1986 | Counihan . | |
| 4,856,250 | 8/1989 | Gronau et al. . | |
| 4,879,857 | 11/1989 | Peterson et al. . | |
| 5,016,413 | 5/1991 | Counihan . | |
| 5,369,927 | 12/1994 | Counihan . | |
| 5,388,380 | 2/1995 | Niese | 52/480 |
| 5,497,590 | 3/1996 | Counihan . | |
| 5,647,183 | 7/1997 | Counihan . | |
| 5,778,621 | 7/1998 | Randjelovic | 52/403.1 |
| 5,887,331 | 3/1999 | Little | 52/480 X |
| 5,906,082 | 5/1999 | Counihan | 52/403.1 |

*Primary Examiner*—Beth A. Stephan
*Assistant Examiner*—Brian E. Glessner
*Attorney, Agent, or Firm*—Henry S. Jaudon; Cort Flint

[57] ABSTRACT

A resilient base flooring for assembly on a base surface having a plurality of sub-floor panels carried above the base surface in substantial side-by-side and end-to-end arrangement to form a base floor having continuous uninterrupted surfaces. A plurality of flooring boards are secured with and are arranged to extend transversely of the sub-floor panels to define an integral flooring system. Resilient members are disposed between the sub-floor panels and the base surface to provide resilient support for the integral flooring. A first limit bar is connected with the base surface and a second limit bar is supported by an inner surface of the sub-floor panels. The limit bars have overlying edges which interact beneath the lower surface of the sub-flooring panels to limit vertical movement of the integral flooring.

19 Claims, 2 Drawing Sheets

RESILIENT FLOORING

BACKGROUND OF THE INVENTION

The present invention relates to a resilient flooring system for gymnasiums and like areas.

Prior resilient flooring systems are known which provide resiliency for athletic activities such as aerobics, gymnastics and the like. U.S. Pat. Nos. 5,016,413 and 5,647,183, to the same inventor, are examples of known systems in which resiliency is achieved by providing a resilient covering over the base floor and supporting sub-floor sections in place over the resilient covering. The sub-floor sections are secured with the base floor by channel members which engage within slots formed between adjacent of the sub-floor sections. The channel members are secured with the base floor by nails.

It has been found that an uneven sound or feel is created when pressure is applied to the flooring surface directly over one of the slots created between the spaced ends of the sub-floor panels such as formed in the arrangement of the above referred to U.S. Pat. No 5,016,415. U.S. Pat. No. 5,647,183 makes an attempt to remedy this problem, however, when the brads or nails used to secure the finished flooring with the sub-flooring pass into one of the slots there is not sufficient sub-flooring present for them to engage with. This creates a situation where, over time, they may work their way out and extend above the finished surface. This of course is unacceptable.

Accordingly, it is an object of the present invention to provide a resilient flooring system which may be easily and quickly installed.

Another object of the present invention is to provide a resilient flooring system which comprises continuous sub-floor surface.

Another object of the present invention is to provide a resilient flooring which removes high and low spots present in the base floor.

Another object of the invention is a resilient flooring with no dead spots.

Another object of the invention is to provide a flooring system with a sub-floor to which the finished flooring is evenly secured.

SUMMARY OF THE INVENTION

The above objectives are accomplished according to the present invention by providing a resilient flooring system for assembly on a base surface. The system includes a plurality of sub-floor panels having upper and lower surfaces arranged to generally co-extend over the base surface in side-by-side relationship. There are a plurality of resilient members arranged over the base surface upon which the panels are supported.

Each panel includes a pair of end portions. Each end portion is formed to include an upper or lower edge spaced therefrom to form a lower and an upper ledge respectively. The upper ledge is located to have its upper surface co-extend with the upper surface of the panel while the lower ledge is located to have its lower surface co-extend with the lower surface of the sub-floor panel.

The end portions of the sub-floor panel are arranged to be generally end to end with the upper and lower ledges in over lapping relationship forming substantially uninterrupted sub-floor surfaces over the base surface.

A limit member is secured with the base floor and is carried by a sub-floor panel. The limit member functions beneath the sub-floor to allow limited vertical movement of the flooring system.

The resilient members may comprise a single member between the limit members or spaced strips or spaced individual pads arranged between the limit members.

The panels preferably comprise an upper and a lower plywood sheet of equal thickness, generally ½", secured together one on the other. The lower sheet may alternatively be preferably thicker than the upper sheet being ¾" plywood while the upper sheet is ¼" plywood. The lower sheet is slightly shorter by between about ⅛" and ¼" than the upper sheet.

In use, the sheets are arranged one over the other with one end of the upper sheet overhanging the end of the lower sheet forming a ledge while at the opposite end the lower sheet extends beyond the upper sheet forming a second ledge. This creates upper and lower ledges.

The limit member comprises first and second limit bars. The first limit bar is carried between the upper and the lower plywood sheet at one end of the panel while the second limit bar is secured to the base surface. Each limit bar is provided with an extension connected with a vertical leg. In operation, the extension of the lower limit bar extends above the extension of the upper limit bar and acts to limit vertical movement of the flooring system. The extensions may be covered with padding members. The vertical leg of the upper limit bar extends down through the gap formed between the panel members to locate the lower extension beneath the lower surface of the panel members where it is engaged by the extension of the upper limit bar.

A resilient base flooring for assembly on a base surface comprising a plurality of sub-floor panels carried above the base surface in substantial side-by-side and end-to-end arrangement to form a base floor having a continuous uninterrupted upper and lower surface. A plurality of flooring boards, which are arranged to extend transversely of the sub-floor panels to form the floor, are secured with the sub-floor panels by suitable securing members forming an integral flooring system.

Resilient members are disposed between the sub-floor panels and provide the basis for the resilient support for the integral flooring. A first limit bar is connected with the base surface and transversely of the sub-floor panels. A second limit bar is connected between the upper and lower plywood sheets forming the panel and is overlaid by an upper ledge. The second limit bar includes a vertical extension which extends through a gap formed between ends of lower plywood sheet panels. An engaging edge extends from the vertical leg to a position beneath the lower surface of the sub-floor where it is engaged with an edge of the first limit bar. The overlaying edges interact to limit vertical movement of the integral flooring.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
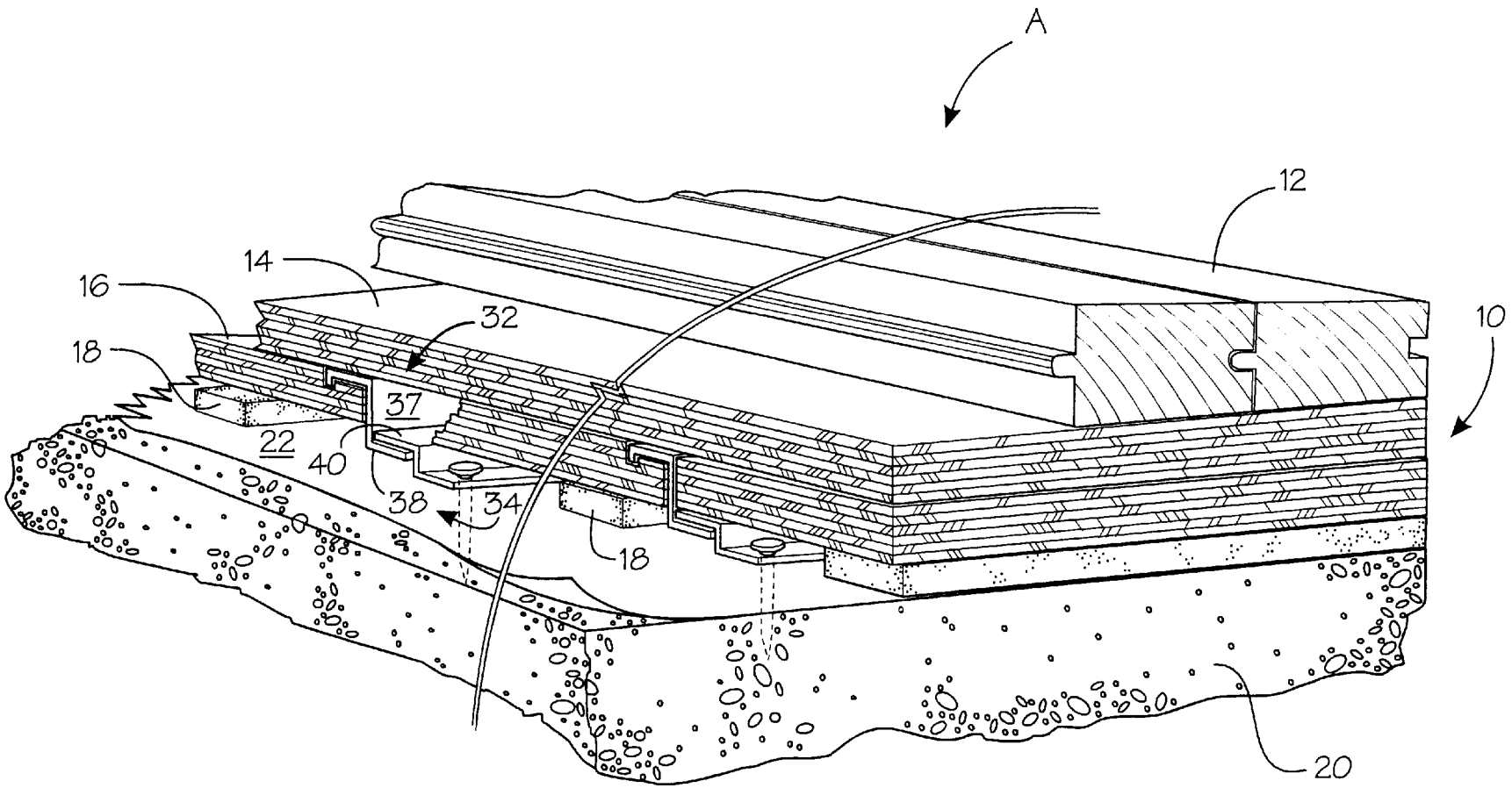
FIG. 1 is a sectional perspective view of the resilient flooring system of the invention.

Turning to the drawings, FIG. 1, flooring system A of the invention is shown attached with base floor 20. System A includes flooring boards 12, generally hardwood, secured with sub-flooring 10, comprised of sub-flooring panels 14, by usual means such as brads or nails (not shown). Sub-flooring panels 14 are supported by foam strips or pads 18 which are separated from base floor 20 by plastic sheets 22. Foam strips or pads 18 which are between 1" and 1½" thick may be spaced as shown or may be of equal size of panels 14 and arranged as foam members.

Figure 2:
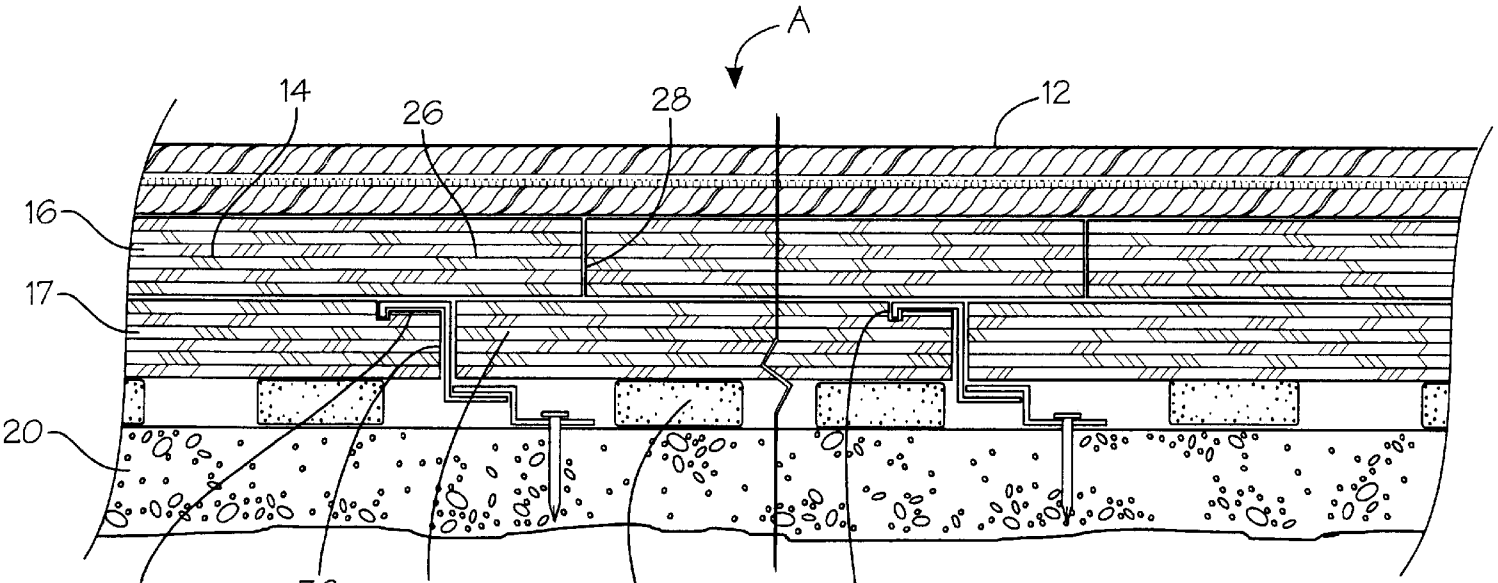
FIG. 2 is a sectional side view of the resilient flooring system of the invention.
Figure 3:
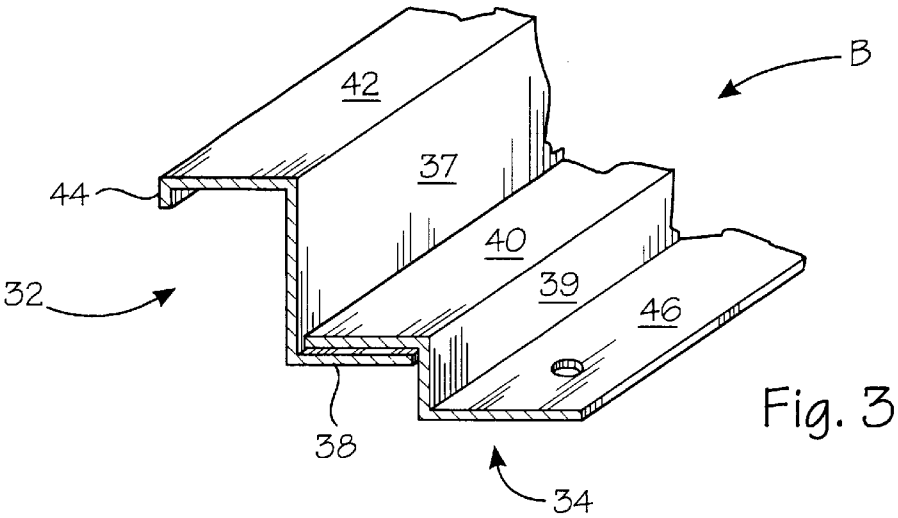
FIG. 3 is a sectional perspective view of the limit bars used to secure the flooring system of the invention.

As best shown in FIGS. 2 and 3, the sub-flooring 10 of flooring system A includes a plurality individual panels 14 arranged over base floor 20 in a generally side-by-side manner. Each panel generally comprises two plywood ½", 2'×4' sheets 16, 17 secured together. Alternatively, each panel may be formed of a ¼" upper plywood sheet secured with a ¾" lower plywood sheet. Of course each panel 14 could be comprised of a shaped single sheet.

Each end of the plywood panels 14 is formed to have a lower ledge 24 and an upper ledge 26. Generally ledges 24 and 26 are formed by securing sheets 16, 17 together with an end of upper sheet 16 overlaying an end of lower sheet 17. Lower and upper ledges 24, 26 are arranged so that the upper surface of upper ledges 26 is an extension the upper surface of panel 14. Lower ledge 24 is formed at the opposite end of panel 14 with its lower surface forming an extension of the lower surface of panel 14. Ledges 24 and 26 are formed to be substantially of equal length, however lower ledge is about ⅛" to ¼" shorter than the upper ledge 26. This allows upper ledges 26, when installed, to overlay completely lower ledges 24 and to engage or abut with the opposed end of sheet 16 as shown at 28 in FIG. 2. Lower ledge 24, when installed, is located slightly spaced from the opposed end of sheet 17 forming gap 36 which opens onto the lower surface of sub-flooring 10.

The end of lower sheet 17 of each panel 14 which is adjacent upper ledge 26, has formed along its upper surface and across its width a slot 50 which is about 1" in length and between ⅛" to ¼" deep. At its innermost end a ⅛" to ¼" groove 52 is formed across the width of panel 17.

A securing member B is formed of a pair of substantially Z shaped bars 32, 34. Bars 32, 34 are provided with a vertical extension 37, 39 which carry oppositely directed edges 38, 40. Edges 38, 40 are designed to overlay one another as clearly shown in FIG. 3.

An upper extension 42 of bar 32 is formed with a downwardly extending rail 44. Extension 42 is adapted to overlay slot 50 with rail 44 engaging in slot 50. Panel 16 when secured with sheet 17 retains bar 32 in this position. Bar 32 is preferably secured during assembly of panel 14, prior to assemblage of flooring system A.

Bar 34 includes a lower extension 46 which is adapted to be secured with base floor 20 by any suitable means such as nails or brads.

It is noted that extension 37 of bar 32 must be of a length which is about ¼" greater than the width of sheet 17. This allows sufficient clearance between its upper surface and the lower surface of panel 14 to allow for vertical movement of the flooring system A.

Flooring system A is assembled over base floor 20 in the following manner.

A plastic sheet 22 is placed over the base floor to hold moisture away from the flooring system. Resilient pads 18 are placed over the plastic sheet in a spaced and generally parallel arrangement over the entire base floor. A number of securing rows of bars 34 are attached with the base floor.

Sub-floor panels 14, with bar 32 attached, are placed over elastic pads 18 in general side by side arrangement. Opposed ends of panels 14 are placed in substantial end to end contact forming sub-floor 10 with a substantially continuous upper and lower surface. Vertical extension 37 extend through and substantially fills gap 36 with edge 38 projecting below the lower surface of sub-flooring panels 14 as clearly shown in FIG. 2.

Bar 34 of securing member B is secured with sub-floor 20 with its edge 40 directed toward edge 38 of bar 32. Edge 40 is connected over the upper surface of lower edge 38 allowing a space to exist between its upper surface and the lower surface panel 14. Also, sufficient space is retained between the lower surface of edge 38 and base floor 20. These spaces allow vertical downward movement of flooring system A while limiting vertical upward movement. It is noted that the height of these spaces is adjustable by varying the thickness of resilient members 18.

Strip flooring 12 is placed over and secured with the sub-floor 10 by usual means such as nails or beads. When attached, the strip or finished flooring 12 and the sub-flooring panels 16 form a unitary flooring surface with no weak spots caused by slots or gaps in the sub-flooring. Because of the elasticity of the foam pads 18, the flooring system A adjusts to eliminate any slight uneveness which may be in the base floor.

While bar 32 along with slot 50 are described as being formed beneath the upper sheet 16 of a formed panel 14, it is understood that slot 50 could be formed along the upper surface of lower extension 24. In this arrangement, it would be the lower surface of extension 26 of opposed panel 14 which acts to retain bar 32 in position.

While a preferred embodiment of the invention has been described using specific terms, such description is for illustrative purposes only, and it is to be understood that change and variations may be made without departing from the spirit or scope of the following claims.

What is claimed is:

1. A resilient flooring system for assembly on a base surface to provide a resilient floor comprising:

a plurality of sub-floor panels having an upper and a lower surface, said panels being arranged to generally co-extend over said base surface in side-by-side relationship;

a plurality of resilient members arranged over said base surface, said resilient members supporting said panel members;

ends of said sub-floor panels include upper and lower edges forming an upper and a lower ledge, said upper and lower ledges being formed on opposite ends of said panels;

said panels being arranged end to end with said upper ledges overlaying said lower ledges forming substantially continuous upper and lower surfaces, said ends of said lower ledges of said sub-floor panels being spaced to form gaps opening onto said base surface;

a first limit member engaged with one of said end-to-end panels and extending through said gap to a position beneath said lower ledge of said lower surface of said panels where said limit member engages with a second limit member, said second limit member being engaged with said base surface, said first and second limit members functioning to allow limited vertical movement of said flooring system; and, exterior flooring secured uniformly with said upper surface of said sub-flooring panels.

2. The flooring system of claim 1 wherein said resilient members comprise pads arranged to be substantially side-by-side and end-to-end over said base surface.

3. The flooring system of claim 1 wherein said resilient members comprise spaced strips.

4. The flooring system of claim 1 wherein said resilient members comprise spaced pads.

5. The flooring system of claim 1 wherein said panels comprise at least an upper and a lower plywood sheet secured together one above the other.

6. The flooring system of claim 5 wherein the lower of said sheets are of equal size.

7. The flooring system of claim 5 wherein said upper sheet is ¼" plywood and said lower sheet is ¾" plywood.

8. The flooring system of claim 5 wherein said sheets are arranged one over the other with an end of said upper sheet extending beyond the corresponding end of said lower sheet creating said upper and lower ledges at opposed ends of said panel.

9. The flooring system of claim 1 including a slot and groove formed across an upper surface of said lower plywood sheet adjacent said one end, said first limit member being connected with said panel by said slot and groove.

10. The flooring system of claim 9 wherein said first limit member includes a flange having a tongue across its outer edge, said flange being located in said slot with said tongue located in said groove.

11. The flooring system of claim 1 wherein a portion of said second limit member extends above a portion of said first limit member to restrict vertical movement of said flooring system.

12. The flooring system of claim 11 wherein padding is provided between said portions.

13. A resilient base flooring for assembly on a base surface comprising:

a plurality of sub-floor panels carried above said base surface in substantial side-by-side and end-to-end arrangement to form a base floor having substantially horizontal continuous and uninterrupted upper and lower surfaces;

flooring boards extending transversely of said sub-floor panels to define a floor and securing members securing said flooring boards with said sub-floor panels forming integral flooring;

resilient members disposed between said sub-floor panels and said base floor to provide resilient support for said integral flooring;

a first limit bar connected with said base floor and extending transversely of said sub-floor panels beneath said continuous and substantially horizontal lower surface of said sub-floor panels;

a second limit bar supported by an inner surface of said sub-floor panels and extending transversely of said sub-floor panels;

said first and second limit bars having overlying edges arranged between said continuous horizontal lower surface of said sub-floor panels and said base surface, said overlying edges interacting to limit vertical movement of said integral flooring.

14. The flooring system of claim 13 wherein each of said sub-floor panels comprise an upper and lower sheet secured together one above the other and offset in one direction forming protruding upper and lower ledges at opposite ends of said panels.

15. The flooring system of claim 14 wherein said sub-floor panels are assembled end-to-end with said upper ledges overlaying said lower ledges forming said substantially uninterrupted upper and lower surface.

16. The flooring system of claim 15 including gaps formed between at least said opposing ends of said lower sheets, said second limit bar extending through said gap a predetermined distance below said lower surface with said overlying edge of said second unit bar being positioned transversely of said gap beneath said lower surface.

17. The flooring system of claim 14 wherein at least the lower wooden sheet is plywood.

18. The flooring systems of claim 14 wherein the lower wooden sheet is of greater thickness than said upper wooden sheet.

19. A resilient base flooring for assembly on a base surface comprising:

a plurality of sub-floor panels carried above said base surface in substantially side-by-side and end-to-end arrangement to form a base floor with upper and lower surfaces, said sub-floor panels comprising at least upper and lower sheets secured together;

a gap formed between adjacent ends of said lower sheets;

a slot formed across each said sub-floor panel, said slot being between an upper surface of said lower sheet and a lower surface of said upper sheet adjacent one end of each said panel;

a groove formed across the inner end of each said slot;

a limit member having a flange with a tongue, said flange extending into said slot with said tongue engaged in said groove securing said limit member with said sub-floor paneling, said limit member extending through said gap to a position beneath said lower surface to engage with said base floor, said limit members functioning to allow limited vertical movement of said flooring system; and, an exterior flooring secured with said upper surface of said sub-floor panels.

* * * * *